US008209908B2

(12) United States Patent
Mori

(10) Patent No.: US 8,209,908 B2
(45) Date of Patent: Jul. 3, 2012

(54) VEHICLE WINDOWPANE HOLDER AND METHOD OF PRODUCING VEHICLE WINDOW ASSEMBLY USING THE SAME

(75) Inventor: Takahito Mori, Yokohama (JP)

(73) Assignee: Faltec Co., Ltd., Kawasaki-Shi (JP)

( * ) Notice: Subject to any disclaimer, the term of this patent is extended or adjusted under 35 U.S.C. 154(b) by 666 days.

(21) Appl. No.: 12/224,842

(22) PCT Filed: Mar. 9, 2007

(86) PCT No.: PCT/JP2007/054696
§ 371 (c)(1),
(2), (4) Date: Oct. 3, 2008

(87) PCT Pub. No.: WO2007/102603
PCT Pub. Date: Sep. 13, 2007

(65) Prior Publication Data

US 2009/0072579 A1 Mar. 19, 2009

(30) Foreign Application Priority Data

Mar. 9, 2006 (JP) ..... 2006-064778

(51) Int. Cl.
*E05F 11/38* (2006.01)

(52) U.S. Cl. ..... 49/374; 49/348; 49/349

(58) Field of Classification Search ..... 49/348, 49/349, 372, 374, 506
See application file for complete search history.

(56) References Cited

U.S. PATENT DOCUMENTS

| | | | | |
|---|---|---|---|---|
| 4,026,088 | A | 5/1977 | Akabane | |
| 4,776,132 | A * | 10/1988 | Gold | 49/375 |
| 4,830,214 | A * | 5/1989 | Curliss et al. | 220/270 |
| 5,050,348 | A * | 9/1991 | Kane et al. | 49/351 |
| 5,502,926 | A * | 4/1996 | Grace et al. | 49/375 |
| 5,513,468 | A | 5/1996 | Diestelmeier | |
| 5,546,704 | A * | 8/1996 | Maruoka | 49/375 |
| 6,330,764 | B1 * | 12/2001 | Klosterman | 49/375 |
| 7,263,804 | B2 * | 9/2007 | Ishii et al. | 49/352 |

FOREIGN PATENT DOCUMENTS

| | | |
|---|---|---|
| JP | U 59-140677 | 9/1984 |
| JP | U 3-38338 | 4/1991 |
| JP | A 8-177307 | 7/1996 |

* cited by examiner

*Primary Examiner* — Gregory J. Strimbu
(74) *Attorney, Agent, or Firm* — Oliff & Berridge, PLC

(57) ABSTRACT

A vehicle windowpane holder for connecting a vehicle windowpane to a window regulator mechanism, including: a leg section to be connected to the window regulator mechanism; a glass holding section including opposed surface portions extending from the leg section and a bottom surface portion, each of the opposed surface portions having a width in a longitudinal direction thereof that gradually increases as the surface portions extend away from the leg section, and the opposed surface portions and the bottom surface portion defining a windowpane receiving groove; and weir portions at both side edges of the opposed surface portions so as to close both ends of the windowpane receiving groove, each of the weir portions extending obliquely relative to a direction perpendicular to the bottom surface portion and are removed upon insertion of the windowpane into the windowpane receiving groove.

8 Claims, 4 Drawing Sheets

Figure 1A:
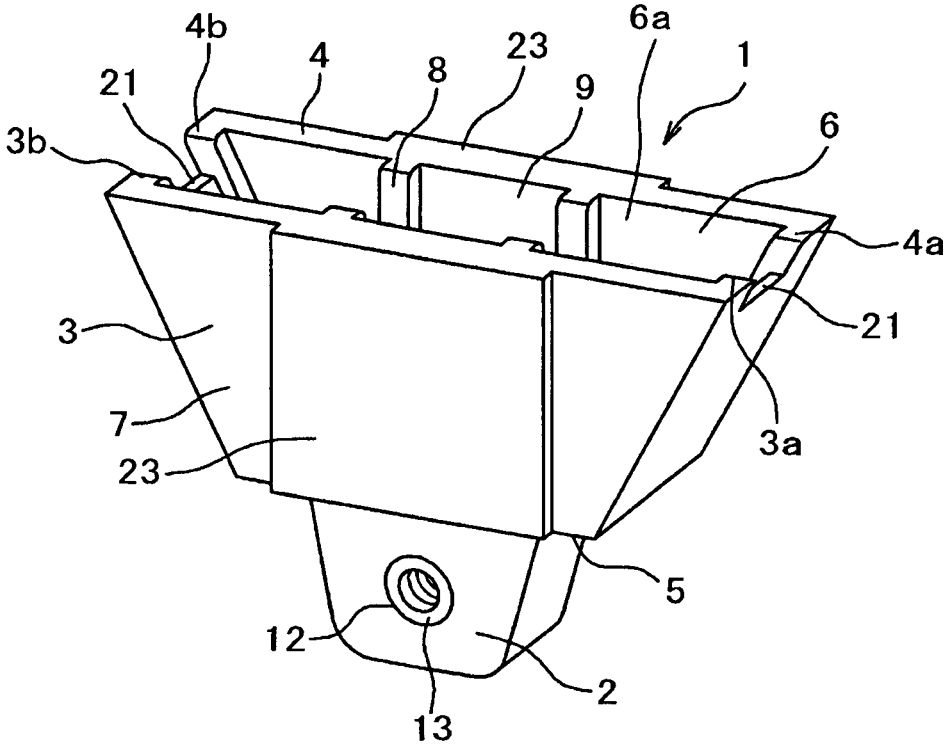

VEHICLE WINDOWPANE HOLDER AND METHOD OF PRODUCING VEHICLE WINDOW ASSEMBLY USING THE SAME

TECHNICAL FIELD

The present invention relates to a windowpane holder for a vertically movable window of a vehicle, and a method of manufacturing a vehicle window assembly using such a windowpane holder.

BACKGROUND ART

In a vertically movable vehicle window, it has been a conventional practice to connect a windowpane to a window regulator mechanism, by holding the windowpane with a windowpane holder, so that the windowpane can be moved vertically by operating the window regulator mechanism. As for the material of the windowpane holder, metallic materials have been used in the past, though synthetic resin materials are currently used. Known windowpane holder made of synthetic resin materials has a holder groove, into which the peripheral region of a windowpane is inserted and held thereby, and an adhesive agent is injected into the holder groove to adhere the windowpane and the glass holder to each other, so as to produce a vehicle window assembly.

For example, Japanese Patent Application Laid-open Publication No. 08-177307 (Patent Document 1) discloses a vehicle windowpane holder that includes a leg section to be connected to a window regulator mechanism, and a windowpane holding section with a windowpane receiving groove defined by opposed surface portions extending from the leg section and having a substantially rectangular shape, and a bottom surface portion. Each of the opposed surface portions has both side edges that are projected inwards toward the corresponding side edges of the opposite surface portion, so as to form an adhesive agent retaining portion. Furthermore, a thin film portion extends inwards from the side edge of the opposed surface portion so as to partly cover the end portion of the windowpane receiving groove. The leg section of the windowpane holder is provided with a connection hole, to which a connection nut is secured.

With the known vehicle windowpane holder, a vehicle window assembly is produced by holding the vehicle windowpane holder with a jig, injecting an adhesive agent into the windowpane receiving groove, inserting a windowpane into the windowpane receiving groove from its opening side, so that the adhesive agent spreads over the adhesive agent retaining portion, causing the windowpane holder to be adhered to the windowpane and thereby completing the assembly. The vehicle window assembly so produced is mounted in place by using a fitting for connecting the leg section of the windowpane holder to a window regulator mechanism that is arranged inside of a vehicle door panel, so as to allow the windowpane to be moved vertically.

In the known vehicle windowpane holder, the provision of the thin film portions extending inwards from the both side edges of the opposed surface portions has for its object to allow assembling of a windowpane with a different thickness. Thus, when a windowpane with a different thickness is assembled, the clearance between the windowpane and the both side edges of the opposed surface portions changes, so that this change is absorbed by the thin film portions. For example, when a thick windowpane is assembled, the edge of the thin film portions is deformed or removed by the windowpane to absorb the change in the clearance. On the contrary, when a thin windowpane is assembled, since the clearance between the opposed surface portions is substantially same as the thickness of the windowpane, the thin film portions are not subjected to deformation or removal. In this instance, however, as compared to the assembling of a thick windowpane, due to an increased clearance between the windowpane and the both side edges of the opposed surface portions, an increased amount of adhesive agent must be injected into the windowpane receiving groove in order to prevent lowering of the adhesion force, thereby requiring management of the injection amount of the adhesive agent.

In the known vehicle windowpane holder, although both ends of the windowpane receiving groove are partly closed by the thin film portions, there still exist openings corresponding to the minimum thickness of the windowpane. Therefore, when the adhesive agent is injected and the windowpane is inserted into the windowpane receiving groove, there may be leakage or spewing of the adhesive agent from the openings at the both ends of the windowpane receiving groove, to contaminate the surroundings or lower the adhesion force.

In connection with such a potential problem, Patent Document 1 describes that the leakage or spewing of the adhesive agent during the assembling is prevented by forming the thin film portions to extend upwards from the bottom surface portion of the windowpane receiving groove, as means for preventing the leakage or spewing of the adhesive agent. However, in the windowpane holder disclosed in Patent Document 1, because the opposed surface portions of the glass holding section extend from the leg section with a rectangular shape, each side edge of the opposed surface portions extends in a direction perpendicular to the leg section. The insertion of the windowpane with respect to the windowpane receiving groove is performed by moving the windowpane in a direction perpendicular to the leg section. Thus, the insertion direction of the windowpane is parallel to the both side edges of the opposed surface portions. As a result, the tip end of the thin film portion as the leakage preventing means may be crushed and removed upon insertion of the windowpane, or the removed pieces or powder-like chaffs may fall onto the bottom surface portion to cause dislocation of the inserted position of the windowpane. Furthermore, the residual part of the thin film portions remaining without having been removed, or the removed chaffs may come into contact with the adhesive agent to lower the adhesion force. Moreover, after the vehicle window assembly so produced has been mounted onto the vehicle, the removed chaffs may fall into inside of the door panel, possibly causing generation of abnormal noise.

DISCLOSURE OF THE INVENTION

It is an object of the present invention to provide a vehicle windowpane holder, which allows the windowpane to be assembled in a facilitated manner, prevents the adhesive agent from leakage or spewing out upon the assembly, and allows the flow out preventing means to be removed in a facilitated manner, thereby preventing insufficiency of the adhesion force and also preventing generation of abnormal noise within the door panel due to the removed flow-out preventing member or its fragment.

It is another object of the present invention to provide a vehicle window assembly using the above-mentioned vehicle windowpane holder, which allows the windowpane to be assembled in a facilitated manner, prevents the adhesive agent from leakage or spewing out upon the assembly, and allows the flow out preventing means to be removed in a facilitated manner, thereby preventing insufficiency of the adhesion force and also preventing generation of abnormal noise within the door panel due to the removed flow-out preventing member or its fragment.

The present invention in its first aspect provides a vehicle windowpane holder for connecting a vehicle windowpane to a vertical moving mechanism, comprising:

a leg section to be connected to the vertical moving mechanism;

a glass holding section including opposed surface portions extending from the leg section to have a gradually increasing width, and a bottom surface portion, said opposed surface portions and said bottom surface portion defining a windowpane receiving groove; and weir portions at both side edges of said opposed surface portions so as to close both ends of the windowpane receiving groove, wherein the weir portions are gradually inclined outwards and removed, upon insertion of the windowpane into the windowpane receiving groove.

Preferably, the vehicle windowpane holder further comprises a thin-walled area at a junction between each of the weir portions and the bottom surface portion.

Preferably, the vehicle windowpane holder further comprises a thick-walled area on an outer surface of at least one of the opposed surface portions.

Preferably, the vehicle windowpane holder further comprises an adhesive agent retaining portion in the opposed surface portions, on the side of the windowpane receiving groove.

Furthermore, the present in its second aspect provides a method of producing a vehicle windowpane holder, which method comprises: injecting an adhesive agent into the windowpane receiving groove; inserting a windowpane from an opening side of the windowpane receiving groove, thereby causing the weir portions to be gradually inclined outwards and removed; and adhering the vehicle windowpane holder and the windowpane to each other, by said adhesive agent.

The vehicle window assembly to be produced according to the present invention is used in a vehicle, in particular an automobile, as a vertically movable window wherein a windowpane can be moved upwards or downwards. The vehicle windowpane holder according to the present invention is used for such a vehicle window assembly, in order to hold the window pane and connect it to a window regulator mechanism so that the windowpane can be moved vertically by the vertical moving mechanism.

In the vehicle windowpane holder according to the present invention, the glass holding section includes opposed surface portions extending to have a gradually increasing width, and a bottom surface portions, and a windowpane receiving groove is defined by these surface portions. At both ends of the opposed surface portions in the glass holding section, there are formed weir portions for closing the ends of the windowpane receiving groove, in such a manner that they are gradually inclined outwards and removed, upon insertion of the windowpane into the windowpane receiving groove. The vehicle windowpane holder according to the present invention can be integrally molded, for example by injection molding process, from a hard synthetic resin such as polyacetal, butyleneterephthalate, etc., or from a resin material in which such hard synthetic resin is mixed with glass fibers or the like reinforcement elements.

Because the opposed surface portions in the windowpane holding section extend from the leg section with a gradually increasing width, the side edges of the opposed surface portions extend obliquely relative to a direction perpendicular to the bottom surface portion, i.e., the direction in which the windowpane is inserted. In this instance, since the insertion of the windowpane is carried out by moving the windowpane in the direction perpendicular to the bottom surface portion, it is preferred that the weir portions formed as thin films extending obliquely relative to the insertion direction of the windowpane, such that they are gradually inclined outwards and removed by a component force generated upon insertion of the windowpane.

While the weir portions may be formed as thin films bridging the opposite side edges of the opposed surface portions so as to be gradually inclined outwards and removed upon insertion of the windowpane, it is preferred that a thin-walled area is formed at a junction between each of the weir portions and the bottom surface portion. It is also preferred that a thin-walled area is formed at a junction between each of the weir portions and the side edges of the opposed surface portions. By forming such thin-walled areas, upon removal of the weir portions by the insertion of the windowpane, the weir portions are more readily inclined outwards and removed.

It is preferred for the windowpane holding section to have a thick-walled area on an outer surface of at least one of the opposed surface portions, so as to ensure that the insertion of the windowpane is not impeded by warping or deformation of the opposed surface portions. It is further preferred that the thick-walled area is formed on the outer surfaces of each opposed surface portion. The formation area, dimension and shape of the thick-walled area are properly determined so as to prevent warping or deformation of the opposed surface portions, in particular warping or deformation due to molding shrinkage.

It is preferred that an adhesive agent retaining portion is formed in the opposed surface portions of the glass holding section, on the side of the windowpane receiving groove, so as to allow a sufficient amount of the adhesive agent to be retained between the glass holding section and the windowpane, and preserve a desired adhesion force. It is preferred for the adhesive agent retaining portion to be formed by the both side edges that are projected inwards, respectively. Furthermore, it is preferred for the adhesive agent retaining portion to be formed by ribs that project inwards at an intermediate region of the opposed surface portions. Moreover, it is preferred for the distance between the opposite side edges, and also for the distance between the opposite ribs, to be substantially the same as the thickness of the windowpane to be inserted.

In the method for producing a vehicle window assembly according to the present invention, the vehicle window assembly is produced by injecting an adhesive agent into the windowpane receiving groove of the vehicle windowpane holder as explained above, inserting a windowpane from an opening side of the windowpane receiving groove, thereby causing the weir portions to be gradually inclined outwards and removed, and adhering the vehicle windowpane holder and the windowpane to each other, by said adhesive agent. The window assembly so produced is used by connecting the leg section of the windowpane holder to a window regulator mechanism, so as to allow the windowpane to be moved vertically, by means of the window regulator mechanism.

In the vehicle windowpane holder according to the present invention, as explained above, the glass holding section includes opposed surface portions extending from the leg section to have a gradually increasing width, and a bottom surface portion, so that these surface portions define the windowpane receiving groove, and weir portions are formed at both side edges of the opposed surface portions so as to close both ends of the windowpane receiving groove, wherein the weir portions are gradually inclined outwards and removed, upon insertion of the windowpane into the windowpane receiving groove. Therefore, the present invention provides a vehicle windowpane holder, which allows the assembling of the windowpane to be carried out in a facilitated manner, the flow-out or leakage of the adhesive agent upon the to be positively prevented, and the removal of the weir portions as the flow-out preventing means to be readily achieved, thereby ensuring a sufficient adhesion force while preventing generation of abnormal noise within the door panel due to the weir portions or removed fragments thereof.

Furthermore, with the method for producing a vehicle window assembly according to the present invention, as explained above, the vehicle window assembly is produced by injecting an adhesive agent into the windowpane receiving groove of the vehicle windowpane holder according to the invention, inserting a windowpane from an opening side of the windowpane receiving groove, thereby causing the weir portions to be gradually inclined outwards and removed, and adhering the vehicle windowpane holder and the windowpane to each other, by the adhesive agent. Therefore, the present invention provides a vehicle window assembly, which allows the assembling of the windowpane to be carried out in a facilitated manner, the flow-out or leakage of the adhesive agent upon the to be positively prevented, and the removal of the weir portions as the flow-out preventing means to be readily achieved, thereby ensuring a sufficient adhesion force while preventing generation of abnormal noise within the door panel due to the wire portions or removed fragments thereof.

BRIEF DESCRIPTION OF THE INVENTION

Figure 1B:
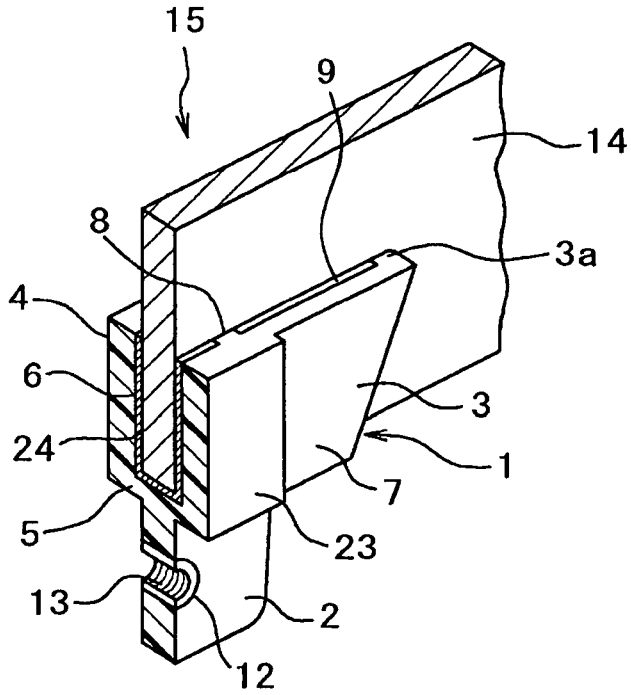

FIG. 1(*a*) is a perspective view showing a vehicle windowpane holder according to one embodiment of the present invention before it is assembled with a windowpane, and FIG. 1(*b*) is a perspective view of a vehicle window assembly after the windowpane has been assembled.

Figure 2A:
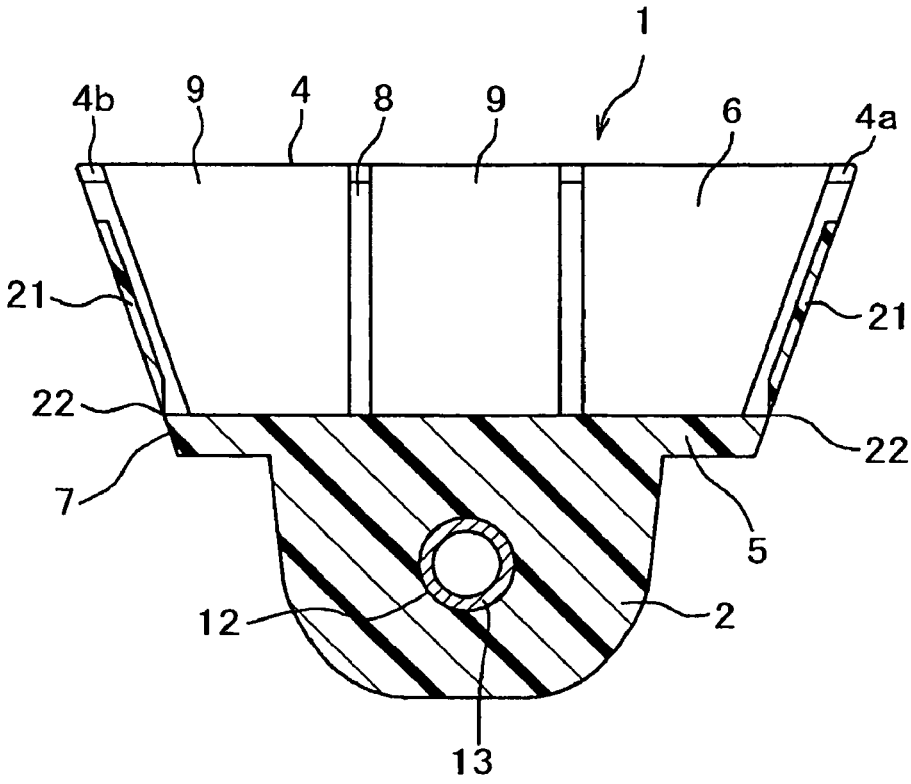
Figure 2B:
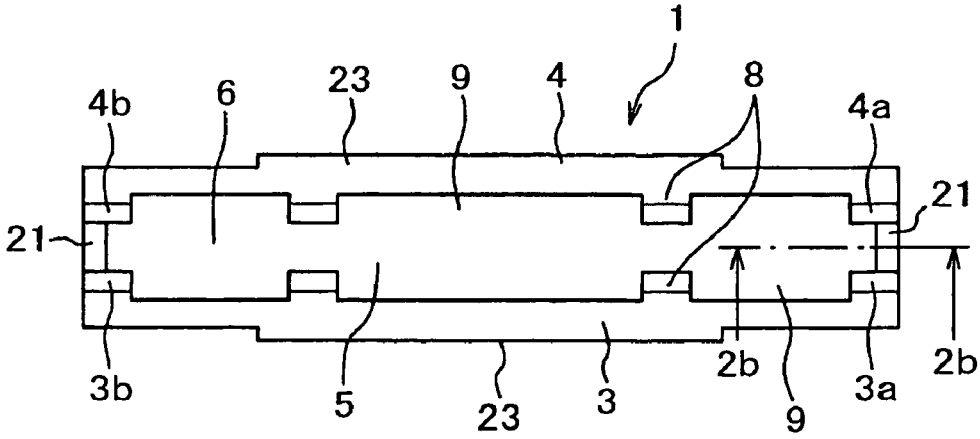

FIGS. 2(*a*) and 2(*b*) are a longitudinal-sectional view and a plan view of the vehicle windowpane holder, respectively.

Figure 3A:
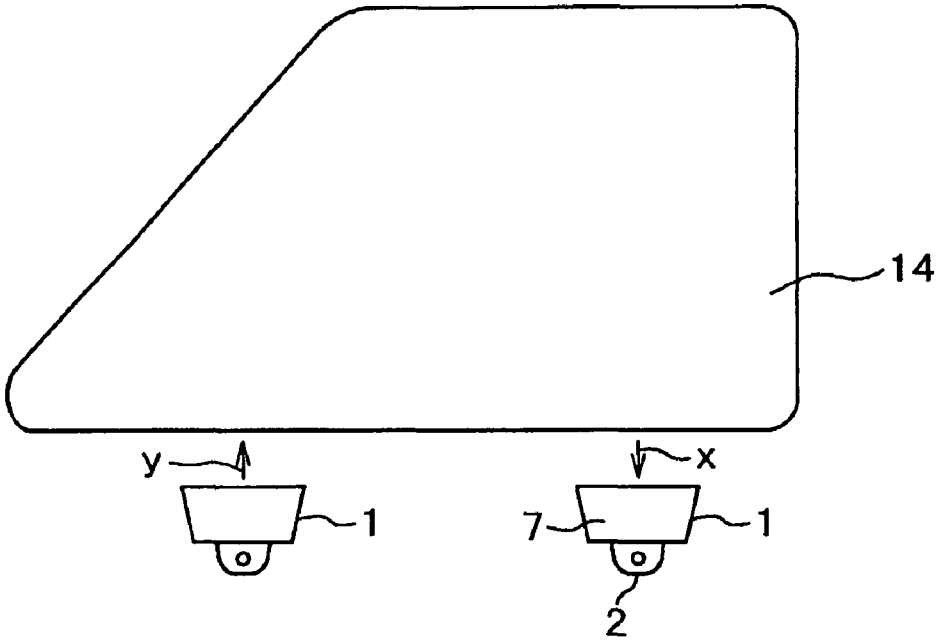
Figure 3B:
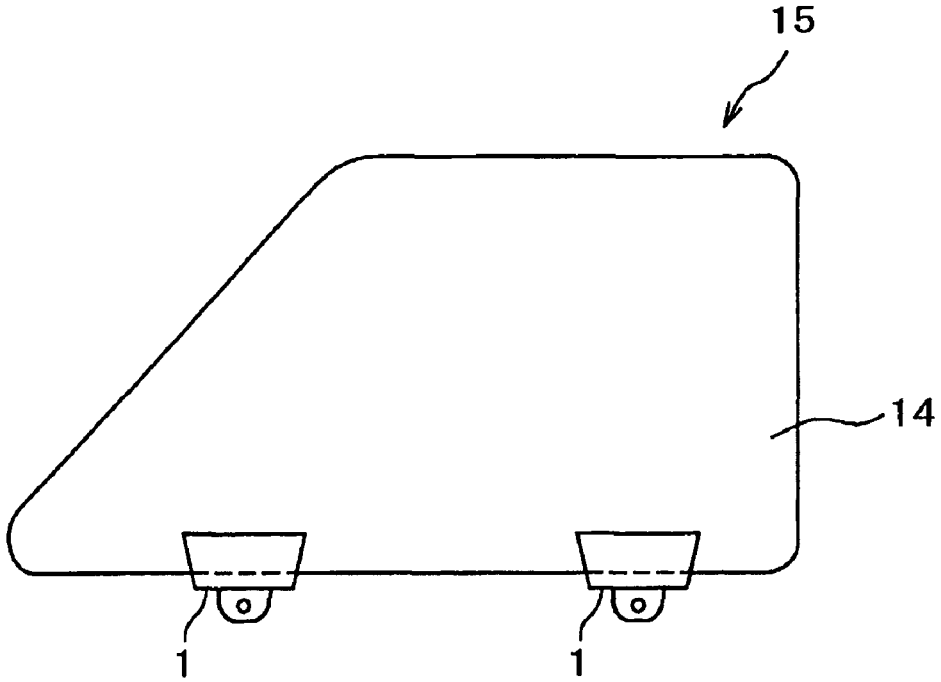

FIGS. 3(*a*) and 3(*b*) are front views of the vehicle window assembly during and after its assembling, respectively.

Figure 4A:
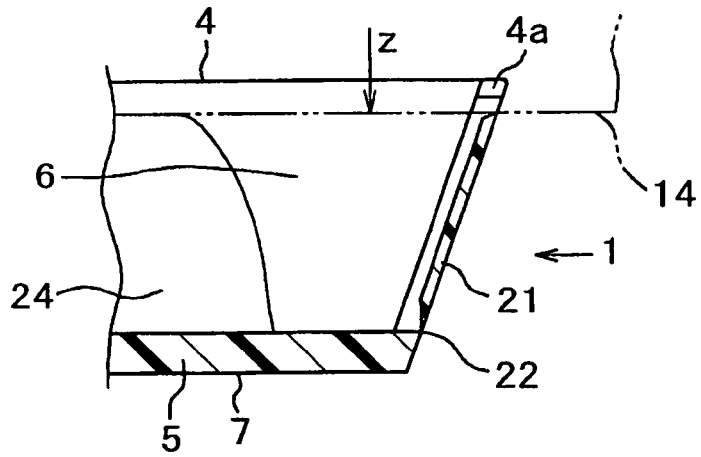
Figure 4B:
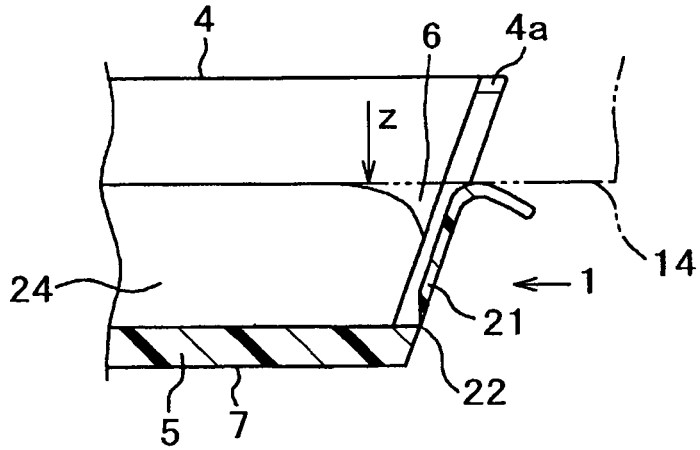
Figure 4C:
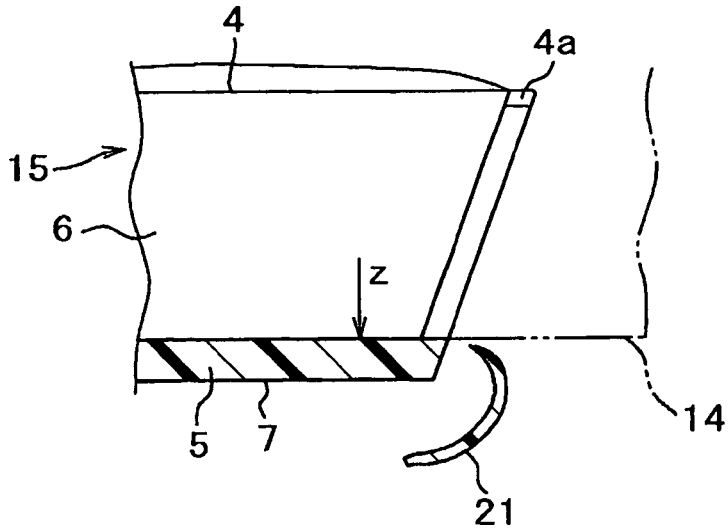

FIGS. 4(*a*), 4(*b*) and 4(*c*) are sectional views taken along the line 2*b*-2*b* in FIG. 2(*b*), and showing successive assembling steps of the vehicle window assembly, respectively.

BEST MODE FOR CARRYING OUT THE INVENTION

The present invention will be described below in further detail, with reference to an illustrated preferred embodiment.

As particularly shown in the drawings, the present invention provides a vehicle windowpane holder 1 which includes a leg section 2 to be connected to a window regulator mechanism (not shown) in a vehicle, as well as a windowpane holding section 7 having a windowpane receiving groove 6 that is defined by opposed surface portions 3, 4 and a bottom surface portion 5. The opposed surface portions 3, 4 extend from the leg section 2 in parallel with each other, with a gradually increasing width. Each opposed surface portion 3, 4 includes side edges 3*a*, 3*b*, 4*a*, 4*b* projecting inwards, and ribs 8 projecting inwards from an intermediate region of the opposed surface portion 3, 4, so as to define an adhesive agent retaining portion 9. A thin film-like weir portion 21 extends from the inner side at each side edges 3*a*, 3*b*, 4*a*, 4*b* of the opposed surface portions 3, 4 inwards, so as to bridge over the side edge 3*a*, 4*a* and the opposite side edge 3*b*, 4*b* and thereby close the ends of the windowpane receiving groove 6. Thin-walled portions 22 are formed at the junction between the weir portions 21 and the bottom surface portion 5. A connection hole 12 is formed in the leg section 2, to which a connector fitting 13 in the form of a nut is secured by insert-molding or the like.

In the windowpane holder 1 having a construction as explained above, because the opposed surface portions 3, 4 in the windowpane holding section 7 extend from the leg section 2 with a gradually increasing width, the side edges 3*a*, 3*b*, 4*a*, 4*b* of the opposed surface portions 3, 4 extend obliquely relative to a direction perpendicular to the bottom surface portion 5, i.e., the direction in which the windowpane 14 is inserted. In this instance, since the insertion of the windowpane 14 is carried out by moving the windowpane 14 in the direction perpendicular to the bottom surface portion 5, the weir portions 21 extend obliquely relative to the insertion direction (x, y, z) of the windowpane 14.

Each weir portion 21 has a tip edge situated at a location that is retracted from the upper ends of the side edges 3*a*, 3*b*, 4*a*, 4*b* in the opposed surface portions 3, 4. The inner edge region at the upper end of the side edge 3*a*, 3*b*, 4*a*, 4*b* free from the weir portion 21 is chamfered to facilitate insertion of the windowpane 14, and extends in an oblique manner. The windowpane holding section 7 is formed with thick-walled areas 23 on the outer surface side of the opposed surface portions 3, 4.

While the windowpane holder 1 having the structure as explained above is produced as being integrally molded, for example by injection molding process, from a hard synthetic resin such as polyacetal, butyleneterephthalate, etc., or from a resin material in which such hard synthetic resin is mixed with glass fibers or the like reinforcement elements, the weirs 21 are provided to avoid a situation wherein the insertion of the windowpane 14 may be otherwise impeded due to warping or deformation generated upon molding shrinkage. Since the opposed surface portions 3, 4 are cooled from the side of the upper opening 6*a*, when the leg section 2 is subsequently cooled and undergoes shrinkage, the upper region of the opposed surface portions 3, 4 would normally tend to be deformed and inclined inwards, thereby narrowing the entrance of the windowpane receiving groove 6 and impeding the insertion of the windowpane 14. On the other hand, the weir portions 21 provided at the side edges 3*a*, 3*b*, 4*a*, 4*b* of the opposed surface portions 3, 4 are in the form of a thin film and thus rapidly cooled without causing inclination of the opposed surface portions 3, 4. Nevertheless, the center region of the weir portion 21 would normally tend to be deformed and warps inwards so as to impede the insertion of the windowpane 14. However, the provision of the thick-walled area 23 at the center region of the outer surface of the opposed surface portions 3, 4, it is possible to ensure that the opposed surface portions 3, 4 and the leg section 2 are cooled with the same timing, thereby preventing occurrence of warping, deformation or the like due to the molding shrinkage.

The windowpane holder 1 explained above is assembled to produce a vehicle window assembly 15, either by inserting the windowpane 14 in the direction x in FIG. 3(*a*), with the windowpane holder 1 held by a jig, or by moving the windowpane holder 1 in the direction y in FIG. 3(*a*), with the windowpane holder 1 held by a robot, so as to be secured to the windowpane 14. The details of the assembling steps will be described below with reference to FIGS. 4(*a*) to 4(*c*), wherein the arrow z indicates the relative movement direction of the windowpane 14.

Upon assembling of the windowpane holder 1 to the windowpane 14, first of all, an adhesive agent 24 is injected into the windowpane receiving groove 6. The windowpane 14 is inserted into the windowpane receiving groove 6, from the side of its opening 6*a*, so as to cause the weir portions 21 to be inclined outwards and removed, while spreading the adhesive agent 24 over the adhesive agent retaining portion 9. The windowpane holder 1 is assembled and fixedly secured to the windowpane 14 by the adhesive agent 24, to produce the vehicle window assembly 15. The window assembly 15 so produced is used by connecting the leg section 2 of the windowpane holder 1 to a window regulator mechanism, so as to allow the windowpane 14 to be moved vertically, by means of the window regulator mechanism (not shown).

In the assembling steps, first of all, as shown in FIG. 4(*a*), the lower edge of the windowpane 14 is inserted from the upper edge of the windowpane receiving groove 6, and brought into contact with the upper edge of the weir portion 21, so as to shut-off the leakage path of the adhesive agent 24. In such a state, as shown in FIG. 4(*b*), the windowpane 14 is moved downwards, thereby causing the weir portion 21 to be inclined outwards and removed from its upper edge side. Sine the windowpane 14 can be inserted while shutting-off the leakage path of the adhesive agent 24, the adhesive agent 24 is spread over the adhesive agent retaining portion 9 without undesirable flow-out or leakage. Furthermore, when the windowpane 14 is inserted to the position as shown in FIG. 4(*c*), the weir portion 21 can be readily separated because the weir portion 21 is cut at the thin-walled area 22 and falls on the outer side. On this occasion, the adhesive agent 24 has already been uniformly spread over the adhesive agent retaining portion 9 to exhibit the required adhesion strength. The production of the vehicle window assembly is completed after the curing of the adhesive agent 24.

In the windowpane holder 1 having the construction as explained above, because the opposed surface portions 3, 4 in the windowpane holding section 7 extend from the leg section 2 with a gradually increasing width, the side edges 3*a*, 3*b*, 4*a*, 4*b* of the opposed surface portions 3, 4 extend obliquely relative to a direction perpendicular to the bottom surface portion 5, i.e., the direction in which the windowpane 14 is inserted. Therefore, the weir portions 14 can be inclined outwards and removed by a component force that is generated upon insertion of the windowpane 14. In other words, it is possible to avoid a situation as would be inevitable in the prior art, where the weir portion 21 is crushed and removed upon insertion of the windowpane 14, or the removed pieces or powder-like chaffs remain inside the windowpane holder 1 and come into contact with the adhesive agent 24 to lower the adhesion force. Also, the weir portions 21 can be readily inclined outwards and removed, since they are in the form of a thin film bridging the side edges 3*a*, 3*b*, 4*a*, 4*b* of the opposed surface portions 3, 4. Moreover, the provision of a thin-walled area 22 at the junction between the weir portions 21 and the bottom surface portion 5 makes it possible readily to remove the weir portion 21 as it is inclined outwards.

Since the windowpane holding section 7 is provided with a thick-walled area 23 on the outer surface of the opposed surface portions 3, 4, it is possible to prevent the insertion of the windowpane 14 from being impeded due to warping or deformation of the opposed surface portions 3, 4. Furthermore, since an adhesive agent retaining portion 9 is formed on the side of the windowpane receiving groove 6 of the opposed surface portions 3, 4, it is possible to retain a sufficient amount of the adhesive agent 24 between the opposed surface portions 3, 4 and the windowpane 14, so as to exhibit the required adhesion strength. The adhesive agent retaining portion 9 is defined by the side edges of the opposed surface portions 3, 4, each projecting inwards, and also by ribs 8 projecting inwards from the intermediate region of the opposed surface portions 3, 4. Such an arrangement makes it possible to preserve the capacity of the adhesive agent retaining portion 9 and to prevent deformation of the opposed surface portions 3, 4. Furthermore, since the distance between the opposite side edges 3*a*, 3*b*, 4*a*, 4*b*, and the distance between the opposite ribs 8 are substantially the same as the thickness of the windowpane to be inserted, it is possible to positively prevent flow-out of the adhesive agent 24 and ensure that the windowpane 14 and the windowpane holder 1 can be precisely assembled to each other without inclination.

It will be appreciated from the foregoing description that, with the vehicle windowpane holder according to the present invention, as explained above, the glass holding section includes opposed surface portions extending from the leg section to have a gradually increasing width, and a bottom surface portion, so that these surface portions define the windowpane receiving groove, and weir portions are formed at both side edges of the opposed surface portions so as to close both ends of the windowpane receiving groove, wherein the weir portions are gradually inclined outwards and removed, upon insertion of the windowpane into the windowpane receiving groove. Therefore, the present invention provides a vehicle windowpane holder, which allows the assembling of the windowpane to be carried out in a facilitated manner, the flow-out or leakage of the adhesive agent upon the to be positively prevented, and the removal of the weir portions as the flow-out preventing means to be readily achieved, thereby ensuring a sufficient adhesion force while preventing generation of abnormal noise within the door panel due to the wire portions or removed fragments thereof.

Furthermore, with the method for producing a vehicle window assembly according to the present invention, as explained above, the vehicle window assembly is produced by injecting an adhesive agent into the windowpane receiving groove of the vehicle windowpane holder according to the invention, inserting a windowpane from an opening side of the windowpane receiving groove, thereby causing the weir portions to be gradually inclined outwards and removed, and adhering the vehicle windowpane holder and the windowpane to each other, by said adhesive agent. Therefore, the present invention provides a vehicle window assembly, which allows the assembling of the windowpane to be carried out in a facilitated manner, the flow-out or leakage of the adhesive agent upon the to be positively prevented, and the removal of the weir portions as the flow-out preventing means to be readily achieved, thereby ensuring a sufficient adhesion force while preventing generation of abnormal noise within the door panel due to the wire portions or removed fragments thereof.

The invention claimed is:

1. A vehicle windowpane holder for connecting a vehicle windowpane to a window regulator mechanism, comprising:

a leg section to be connected to the window regulator mechanism;

a glass holding section including a pair of opposed surface portions extending from the leg section and a bottom surface portion, each of said opposed surface portions having a width in a longitudinal direction thereof that gradually increases as said opposed surface portion extends away from the leg section, and said opposed surface portions and said bottom surface portion defining a windowpane receiving groove; and weir portions at both side edges of said opposed surface portions which close both side ends of said windowpane receiving groove, each of said weir portions extending obliquely relative to a direction perpendicular to a surface of said bottom surface portion that defines a bottom of said windowpane receiving groove and are removed by the windowpane as the windowpane is inserted into said windowpane receiving groove.

2. The vehicle windowpane holder according to claim 1, which further comprises a walled area at a junction between each of said weir portions and said bottom surface portion, each of said walled areas having a thickness which is less than a thickness of each of said weir portions and said bottom surface portion.

3. A method of producing a vehicle window assembly with the vehicle windowpane holder as set forth in claim 2, said method comprising:

injecting an adhesive agent into the windowpane receiving groove;

inserting the windowpane into the windowpane receiving groove from an opening side of the windowpane receiving groove, thereby causing the weir portions to be inclined outwards and separated from said glass holding section; and adhering the vehicle windowpane holder and the windowpane to each other, by said adhesive agent.

4. The vehicle windowpane holder according to claim 1, which further comprises a walled area on an outer surface side of at least one of said opposed surface portions that is thicker than other portions of said at least one of said opposed surface portions.

5. A method of producing a vehicle window assembly with the vehicle windowpane holder as set forth in claim 4, said method comprising:

injecting an adhesive agent into the windowpane receiving groove;

inserting the windowpane into the windowpane receiving groove from an opening side of the windowpane receiving groove, thereby causing the weir portions to be inclined outwards and separated from said glass holding section; and adhering the vehicle windowpane holder and the windowpane to each other, by said adhesive agent.

6. The vehicle windowpane holder according to claim 1, which further comprises an adhesive agent retaining portion in each of said opposed surface portions.

7. A method of producing a vehicle window assembly with the vehicle windowpane holder as set forth in claim 6, said method comprising:

injecting an adhesive agent into the windowpane receiving groove;

inserting the windowpane into the windowpane receiving groove from an opening side of the windowpane receiving groove, thereby causing the weir portions to be inclined outwards and separated from said glass holding section; and adhering the vehicle windowpane holder and the windowpane to each other, by said adhesive agent.

8. A method of producing a vehicle window assembly with the vehicle windowpane holder as set forth in claim 1, said method comprising:

injecting an adhesive agent into the windowpane receiving groove;

inserting the windowpane into the windowpane receiving groove from an opening side of the windowpane receiving groove, thereby causing the weir portions to be inclined outwards and separated from said glass holding section; and adhering the vehicle windowpane holder and the windowpane to each other, by said adhesive agent.

* * * * *